United States Patent [19]

Waters et al.

[11] Patent Number: 4,923,535

[45] Date of Patent: May 8, 1990

[54] POLYMER BINDING OF PARTICULATE MATERIALS

[75] Inventors: Paul F. Waters, Washington, D.C.; Albert F. Hadermann, Ijansville, Md.; Jerry C. Trippe, Fairfax Station, Va.

[73] Assignee: General Technology Applications, Inc., Manassas, Va.

[21] Appl. No.: 359,046

[22] Filed: Mar. 17, 1982

[51] Int. Cl.[5] ..... C06B 45/10

[52] U.S. Cl. ..... 149/19.1; 149/19.4; 149/19.9; 149/19.91; 149/19.92

[58] Field of Search ..... 149/19.4, 19.92, 19.1, 149/19.91, 19.9

[56] References Cited

U.S. PATENT DOCUMENTS

| | | | |
|---|---|---|---|
| 3,245,850 | 4/1966 | Harbert | 149/19 |
| 3,651,008 | 3/1972 | Moser et al. | 260/37 |
| 3,685,163 | 8/1972 | Olt | 149/19.92 |
| 3,892,610 | 7/1975 | Huzinec | 149/19.92 |
| 3,932,242 | 1/1976 | Bartley et al. | 149/19.9 |
| 3,953,257 | 4/1976 | Ayers et al. | 149/7 |
| 4,021,378 | 5/1977 | Frisch et al. | 260/2.5 B E |
| 4,036,944 | 7/1977 | Blytas | 423/648 R |
| 4,115,166 | 9/1978 | Lista et al. | 149/7 |
| 4,177,227 | 12/1979 | Harvey et al. | 149/19.92 |
| 4,315,884 | 2/1982 | Van Gasse | 264/255 |
| 4,340,076 | 7/1982 | Weltzen | 137/13 |
| 4,440,916 | 4/1984 | Waters et al. | 525/54.2 |

*Primary Examiner*—Edward A. Miller

*Attorney, Agent, or Firm*—Roland H. Shubert

[57] ABSTRACT

The oxidizer and fuel components of propellant and explosive charges are bound within a polymer matrix to form a structurally sound composite shape of uniform consistency by comminuting and admixing the polymer and oxidizer and fuel components at cryogenic temperatures, compacting the mixture into a desired shape and warming the shaped compact to at least ambient temperatures. In one preferred embodiment, propellant charges for rockets and munitions and the like are fabricated by pressing or extruding a polymer-oxidizer-fuel mixture into selected shapes.

17 Claims, No Drawings

POLYMER BINDING OF PARTICULATE MATERIALS

BACKGROUND OF THE INVENTION

This invention relates generally to the binding of finely divided particulate materials within a polymer matrix.

More specifically, this invention relates to a technique for achieving bonding between a polymer matrix and other particulate materials to form a structurally sound composite shape.

One preferred embodiment of this invention relates to the formation of propellant charges suitable for use in rocketry.

DESCRIPTION OF THE PRIOR ART

It is known in the art that the cryogenic grinding of polymeric materials creates free radicals on at least the surfaces of the resulting polymer particles. These free radicals are stable for extended periods of time if the polymer particles are maintained at cryogenic temperatures. Upon warming, the free radicals decay through reaction with any available active moiety.

There is disclosed in commonly owned U.S. patent application Ser. No. 117,235 now U.S. Pat. No. 4,340,076, a process for the rapid dissolution of polymeric materials in compatible liquids. The polymeric material is comminuted at cryogenic temperatures, as by hammer milling, and is thereafter mixed with liquid preferably while still at cryogenic temperature. Dissolution of the polymer particles in appropriate liquids is extremely rapid; many orders of magnitude greater than is possible using conventional techniques. It is postulated in that patent application that the phenomenally increased dissolution rate may be, at least in part, due to the presence of free radicals on and in the polymer particles created by the mechanical comminution. Dissolution activity of the polymer particles can be maintained for extended periods of time by storage at cryogenic temperatures, e.g., as a slurry in liquid nitrogen.

A second commonly owned patent application, Ser. No. 198,385 describes a process for solid state free radical reactions in which particles of two different, normally solid, materials are caused to react by generating free radicals on the surfaces of at least one of the solids by mechanical working, as by grinding, at cryogenic temperatures. At least one of the solid materials is a polymeric material while the other may be a second polymer, a catalyst, a lubricity enhancing material, a filler or a pigment.

The use of polymers as binders for solid particulate materials is well known in the fabrication of propellant charges for rocket motors, in the manufacturer of cap-sensitive explosive primers, and in a variety of other explosive devices. Typically, a solid explosive compound or a solid oxider such as ammonium perchlorate is blended with a rubbery polymer and with plasticizers, vulcanizing agent and the like. The blend is then formed into an evenly dispersed mixture by methods such as those used in compounding conventional rubber products. The resulting mixture is thereafter formed into desired shapes by casting, by extrusion or by pressing and is allowed to cure or vulcanize usually at moderately elevated temperatures. One exemplary patent is that to Bartley, et al, U.S. Pat. No. 3,932,242 which is directed to propellant charges having a butyl rubber binder.

SUMMARY OF THE INVENTION

Oxidizing and explosive compounds are bound within a polymer matrix to form a shaped composite having significant physical strength. A polymer binder, preferably a thermoplastic elastomer, is cryogenically comminuted to obtain activated particles having free radicals thereon. The oxidizing or explosive compounds are chilled in a cryogenic refrigerant such as liquid nitrogen and while at that temperature are abraded or ground with sufficient intensity to develop fresh surfaces. Activated polymer particles are admixed with the other compounds making up the composite at cryogenic temperature and the admixture is formed into a shape by molding, extrusion or similar techniques. The formed shape is allowed to warm causing free radical induced reactions among polymer particles and between polymer particles and the other compounds forming the composite.

Hence, it is an object of this invention to provide new techniques for the polymer bonding of particulate solids.

It is a specific object of this invention to provide a method for the fabrication of explosive devices and propellant charges.

A specific object of this invention is to enhance the bonding between a polymer matrix and energetic compounds in the fabrication of propellant and explosive charges.

DETAILED DESCRIPTION OF THE INVENTION

In its broadest form, the process of this invention comprises the binding of solid particulate materials within a polymeric matrix. A polymeric material, preferably a thermoplastic elastomer, is ground or comminuted at cryogenic temperatures to form a relatively finely divided powder. The powder particles display active sites as is evidenced by the presence of free radicals. Particulate materials to be incorporated within the matrix are subjected to mechanical working such as abrasion or grinding while at cryogenic temperatures to develop fresh surfaces. The polymer powder and other particulate materials are then admixed while still at cryogenic temperatures. The admixture is formed into a desired shape with the application of pressure as by molding, pressing or extrusion and allowed to warm causing free radical induced reactions between and among the components in the admixture.

The inventive process is particularly applicable to the fabrication of polymer bonded explosive or propellant charges. Examples of explosive charges to which this process is applicable include the fabrication of high explosive primer charges, bursting charges for artillery shells, conventional shaped charges for oil well perforation, armor penetration and the like, linear shaped charges, detonating cord and similar devices. Propellant charges include rocket propellants and bonded propellants for use in artillery shells, caseless ammunition and the like.

This invention contemplates the admixture of a polymer binder in a minor proportion with an oxidizer material or explosive compound in a major proportion. The polymer binder comprises generally an elastomeric thermoplastic and, in a preferred embodiment, comprises an elastomer capable of cross-linking. The polymer is cryogenically ground or comminuted to obtain as fine a powder as is practicable. Elastomeric polymers become brittle at cryogenic temperatures allowing for ready comminution using devices such as hammer mills and the like. The resulting powder is in a highly active state displaying a high concentration of free radicals and can be preserved in that active state by maintaining the powder at cryogenic temperatures.

An oxidizer material or explosive compound is chilled to cryogenic temperatures and is subjected to abrasion or grinding of at least sufficient intensity to develop fresh surfaces. Burning rate catalysts, cross-linking agents and other modifiers incorporated within the formulation may be treated in the same manner; either in admixture with the polymer or oxidizer material or separately. All of the components making up the formulation are than mixed in suitable proportion at cryogenic temperatures using any appropriate solid-solid mixing device. After uniform mixing is accomplished, the blend is formed into a desired shape under pressure as by pressing or extrusion and is allowed or caused to warm to at least about ambient temperature. During the warm up period, free radical-induced reactions occur between and among the components of the composite to form a coherent solid.

As has been set out previously, elastomeric polymers as a group are suitable as the matrix binder in this invention. Examples include the polyolefins including certain of the polyethylenes, polypropylenes, polybutenes and the like. Particularly preferred polymeric binders include those cross-linkable natural or synthetic rubbers or elastomers including, for example, polybutadiene, isobutylene-styrene, butadiene-acrylonitrile, butadiene-styrene, chloroprene, certain elastomeric polyurethanes, polysulfides, polybutylacrylamides, and other similar elastomers.

Cryogenic grinding or comminution is accomplished at very cold temperatures below about −78° C. which is the equilibrium temperature of a dry ice-acetone bath. Maintenance of cryogenic temperatures during polymer comminution is mandatory and critical in order to prevent immediate decay and/or migration of free radicals produced by the grinding. The obtaining and maintenance of cryogenic temperatures during and after grinding may be accomplished through use of a vaporizing cryogenic refrigerant. It is necessary that the refrigerant used must be both capable of achieving cryogenic temperatures and be essentially non-reactive toward the generated free radicals. A most preferred cryogenic refrigerant is liquid nitrogen which combines a boiling point of about −196° C., essential inertness toward free radicals, relative economy and ready availability.

Oxidizer materials suitable for propellant compositions fabricated through use of this invention include those conventional in the prior art such as ammonium nitrate, ammonium perchlorate alkali metal nitrates, energetic boron compounds and others of similar nature as well as mixtures of two or more such materials. Compounds suitable for use in explosive devices and charges include those materials conventionally considered to be high explosives including nitrated aromatic compounds such as TNT, pentaerythritol tetranitrate (PETN), nitrated guanidines, lead axide and the like. Normally liquid explosive compounds, nitroclycerine for example, may be treated in this process in a fashion similar to that employed with normally solid explosives by dispersing the liquid explosive in a refrigerant to form frozen, solid granules or droplets. Thereafter, the solid granules or droplets are processed in the same fashion as are normally solid compounds.

Materials other than the polymer binder and oxidizer or explosive material may be incorporated into the composites of the invention. Propellant charges may advantageously include burning rate catalysts such as ferric oxide and others as is recognized in the art. Both propellant charges and explosive compositions may include antioxidants and plasticizers in amounts ranging up to about 10% or more based on polymer weight. In general, appropriate antioxidants include those commonly used in rubber formulations. Any suitable rubber plasticizer may be employed in association with the elastomeric binder. Those plasticizers which enhance low temperature properties of the binder are preferred.

It is frequently advantageous to include a metallic fuel or high energy additive to both propellant charges and explosive compositions. The metal preferably is in finely divided form and may be present in an amount ranging from about 2% to about 15% depending upon the oxygen balance of the composition. Aluminum is the preferred metallic fuel although other metals such as magnesium or copper may be substituted therefor as is recognized in the art.

A preferred embodiment of this invention includes a cross-linking agent as part of the composition. Suitable cross-linking agents include those such as sulfur commonly used in the vulcanization of rubber as well as magnesium oxide and the like which are particularly adapted for use with polymers such as chloroprene. These solid cross-linking agents are introduced into the composition by grinding them in a cryogenic state and mixing them with the other components of the composite material.

It is especially advantageous to use normally liquid cross-linking agents in one embodiment of this invention. A great number of such agents are known in the art and include for example the isocyanates such as dimethyl diisocyanate and isophorone diisocyanate, trimethylolpropane di- or tri-allylether, divinyl benezene and similar compounds. Liquid cross-linking agents may be incorporated with and relatively uniformly dispersed through the polymer used as a binder by exposing the polymer, before cryogenic comminution, to the cross-linking agent either in its liquid or vapor form. Sufficient contact time between the polymer and cross-linking agent is allowed for a substantially uniform dispersion of the agent through the polymer to occur. Thereafter the polymer, and the associated cross-linking agent, is subjected to cryogenic grinding in the manner previously described. Alternatively, liquid cross-linking agents can be dispersed in a cryogenic refrigerant and thereafter subjected to comminution as with normally liquid explosive compounds. Concentration of the cross-linking agent may range from about 0.1% to about 10% based upon polymer weight.

It has been set out previously that the oxidizer material or explosive compound is subjected to abrasion or grinding at cryogenic temperatures with sufficient intensity to develop fresh surfaces on the particles. These fresh surfaces are highly active and are believed to enter into some type of chemical bonding with the polymer matrix. In the case of ionic salt oxidizers, ammonium perchlorate or nitrate for example, it is believed that the fresh surfaces contain localized positive and negative charges through the breaking of ionic bonds. Such active surfaces function as polymerization initiators promoting and accelerating the reaction of the polymer and a cross-linking agent to form a network type polymer matrix in the finished composite.

Prior art techniques for the production of propellant charges have recognized the advantages gained through use of very finely divided oxidizer material. The burning rate of a rocket propellant using ammonium perchlorate as an oxidizer, for example, is increased as the average particle size of the oxidizer is decreased. In response to an increased demand for very fast burning propellants, propellant charges commonly include ammonium perchlorate having an average particle diameter on the order of 5 microns or even less.

Comminution of ammonium perchlorate and similar oxidizers is usually accomplished by grinding techniques. Grinding is commonly carried out as a slurry in an inert liquid such as a relatively high boiling point Freon using a vibro-energy grinding mill. Problems encountered in this prior art grinding technique include the tendency of the finely ground oxidizer salt to regrow during grinding, thus prolonging the grinding time, and the tendency of the ground oxidizer to clump and agglomerate after grinding. Attempts have been made to overcome these difficulties by coating the oxidizer particles during grinding through use of various compounds added to the liquid slurry within the grinding mill. See for example U.S. Pat. Nos. 3,953,257 and 4,115,166.

The fresh surfaces on oxidizer or explosive particles required for attainment of superior bonding with the polymer matrix of this invention may be achieved with only a minor degree of size reduction. However, in those embodiments of this invention in which finely divided oxidizer salts are included within the propellant or explosive composition, it is advantageous and preferred to grind the oxidizer at cryogenic temperatures in association with an evaporating liquid cryogenic refrigerant; especially with evaporating liquid nitrogen. By operating at these low temperatures, safety of the grinding step is enhanced because the chances for explosive decomposition of the oxidizer due to localized heating or impact is substantially reduced. Grinding rate appears to be increased either because of the greater brittleness of the oxidizers at low temperatures or because of the greatly slowed tendency toward crystal re-growth. The cryogenically ground salts display free flowing characteristics so long as they are maintained at cryogenic temperatures and show little tendency to reagglomerate.

The proportions of polymer binder and oxidizer material or explosive compound will vary depending upon the desired properties of the resulting composite. However, polymer binder is present in minor amount; from about 5% to about 25% of the composite. It is preferred to include a cross-linking agent with all cross-linkable polymers in an amount ranging from about 0.1% to about 10% based on polymer weight. Other additives including polymer antioxidants, metallic fuels, burning rate catalysts and the like may optionally be included in minor amount depending upon the desired properties of the finished composite. The oxidizer material or explosive compound is present in major amount, typically from about 60% to about 95% by weight of the composite.

The following illustrative example describes use of this invention in preparing a propellant charge.

EXAMPLE

A quantity of hydroxy-terminated polybutadiene is allowed to contact liquid trimethylolpropane diallylether at ambient temperature until about 3% by weight of the cross-linking agent is absorbed by the polymer. The polymer is then chilled in liquid nitrogen and comminuted to a fine powder using a liquid nitrogen cooled hammer mill. The resulting powder is maintained at liquid nitrogen temperatures after comminution.

Dry, unground ammonium perchlorate is charged into an isulated vibro-energy grinding mill. Liquid nitrogen is added to the mill to cool the charge and to provide a liquid grinding medium. The mixture is ground for a sufficient time to achieve the desired size reduction and the mill is then discharged and the powdered ammonium perchlorate is maintained at liquid nitrogen temperature.

Polymer powder and ground ammonium perchlorate are then mixed in a weight ratio of about 1 to 9 using a solid-solid, cone-type mixer taking care to maintain the materials at cryogenic temperatures during mixing. The mixture is then placed in a cylinderical mold and subjected to a pressure; which pressure is maintained until the mold and contained material reach ambient temperature. The resulting coherent shape is suitable for use as a rocket propellant charge.

It has been stressed in the example and throughout the remainder of the disclosure that, in this invention, the components making up the propellant or explosive composite are blended as dry, cryogenically maintained powders. Since these powders are not significantly reactive, either chemically or physically at cryogenic temperatures they can be blended to a uniform consistency with a minimum of effort. In contrast, it is conventional in the prior art to blend the polymer binder and oxidizer material or explosive compound, at normal temperatures by batch mixing using a pug mill, Banbury mixer or similar device. There results from this mixing a very viscous mass, normally like a heavy molasses, and requiring a lengthy time to achieve a uniform dispersion.

A number of embodiments of this invention have been set forth and various other modifications will be apparent to those skilled in the art in view of this disclosure.

We claim:

1. A method for fabricating a polymer bonded propellant or explosive composite comprising:

cryogenically comminuting an elastomeric polymer to obtain a relatively finely divided powder, said powder particles having reactive sites thereon;

mechanically working particles of an active agent comprising an oxidizing material or explosive compound by grinding or abrading said agent at cryogenic temperature with at least sufficient intensity to create fresh surfaces thereon;

maintaining both said polymer particles and other particles of said oxidizing or explosive compound at cryogenic temperatures and admixing said polymer particles and other particles while at cryogenic temperatures, forming said admixed particles into a shape under pressure, and allowing said formed shape to warm thereby causing reactions to occur among the components of the composite.

2. The method of claim 1 wherein said elastomeric polymer is cross-linkable and wherein a cross-linking agent for said polymer is incorporated into the composite.

3. The method of claim 2 wherein said cross-linking agent is normally liquid and is contacted with said polymer before comminution in an amount ranging from about 0.1% to about 10% based on polymer weight.

4. The method of claim 2 wherein said cross-linking agent is normally solid.

5. The method of claim 2 wherein said composite is a propellant and wherein said active agent is an oxidizing material.

6. The method of claim 5 wherein said oxidizing material is selected from the group consisting of ammonium nitrate and ammonium perchlorate.

7. The method of claim 6 wherein said ammonium nitrate or ammonium perchlorate is ground in a mill in the presence of liquid nitrogen for a time sufficient to obtain a very finely divided powder.

8. The method of claim 5 wherein a finely divided metallic fuel is admixed with said polymer particles and other particles at cryogenic temperature.

9. The method of claim 8 wherein said metallic fuel comprises aluminum.

10. The method of claim 5 further including a finely divided burning rate catalyst added to said composite.

11. The method of claim 5 wherein said admixed particles are formed into a shape by placing the mixture into a mold and thereafter pressing.

12. The method of claim 5 wherein said admixed particles are formed into a shape by extrusion.

13. The method of claim 2 wherein said composite is an explosive charge and wherein said active agent is a high explosive.

14. The method of claim 2 wherein said polymer is selected from the group consisting of polybutadiene, isobutylene-stryene, butadiene-acrylonitrile, butadiene-styrene chloroprene, elastomeric polyurethanes, polysulfides, polybutylacrylamides and mixtures thereof.

15. The method of claim 14 wherein said polymer is polybutadiene.

16. A polymer bonded propellant or explosive composite produced by:

cryogenically comminuting an elastomeric polymer to obtain a relatively finely divided powder, said powder particles having reactive sites thereon;

mechanically working particles of an active agent comprising an oxdizing material or explosive compound by grinding or abraiding said agent at cryogenic temperatures with at least sufficient intensity to create fresh surfaces thereon;

mixing said polymer particles with said other particles of said oxidizing or explosive compound and maintaining all said particles at cryogenic temperatures during said mixing;

forming said admixed particles into a shape under pressure at cryogenic temperatures; and allowing said formed shape to warm whereby there is produced a chemical bonding among and between said polymer particles and said other particles of said oxidizing or explosive compound.

17. The composite of claim 16 including a cross-linking agent and a metallic fuel.

* * * * *